US006162130A

United States Patent [19]

Masumoto et al.

[11] Patent Number: 6,162,130

[45] **Date of Patent: *Dec. 19, 2000**

[54] GOLF CLUB HEAD

[75] Inventors: Tsuyoshi Masumoto; Akihisa Inoue, both of Sendai; Yoshitaka Nagai, Asahi-machi; Akihiro Uoya, Kurobe, all of Japan

[73] Assignees: Tsuyoshi Masumoto; Akihisa Noue, both of Sendai; YKK Corporation, Tokyo, all of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/163,443

[22] Filed: Sep. 30, 1998

[30] Foreign Application Priority Data

Oct. 1, 1997 [JP] Japan ..... 9-268712

[51] Int. Cl.[7] ..... A63B 53/04

[52] U.S. Cl. ..... 473/324; 473/324; 473/345; 473/349

[58] Field of Search ..... 473/324, 349, 473/345, 346–348, 325, 326, 327, 328, 329, 330, 331, 332, 333, 334, 335, 336, 337, 338, 339, 340, 341, 342, 344, 350, 290, 282, 291

[56] References Cited

U.S. PATENT DOCUMENTS 4,535,990 8/1985 Yamada .
4,699,383 10/1987 Kobayashi .
4,754,975 7/1988 Aizawa .
5,032,196 7/1991 Masumoto et al. .
5,261,664 11/1993 Anderson .
5,288,344 2/1994 Peker .

FOREIGN PATENT DOCUMENTS 4-367678 12/1992 Japan .
9-135931 5/1997 Japan .

OTHER PUBLICATIONS

"Breakthrough Technology That Will Change The Game Forever"[online]. Liquidmetal Golf, [retrived Jan. 16, 1999]. Retrieved from the Internet: <URL: http://www.liquidmetalgold.com/facts/facts.html>.

"Long Shot for Zirconium" [online]. American Metal Market—Roskill Metals Analysis, 1997 [retrieved Aug. 29, 1999]. Retrived from the Internet: <URL: http://204.243.31.24/inside/roskanal/1997/rosk0808.html>.

*Primary Examiner*—Sebastiano Passaniti
*Attorney, Agent, or Firm*—Finnegan, Henderson, Farabow, Garrett & Dunner, L.L.P.

[57] ABSTRACT

A golf club head comprising a face portion and a main body portion, wherein at least the face portion or a face of the face portion comprises an amorphous alloy having a glass transition range. The amorphous alloy preferably has a composition represented by the general formula $X_aM_bAl_c$ (where X is at least one element selected from the group consisting of Zr and Hf, M is at least one element selected from the group consisting of Mn, Fe, Co, Ni, Ti and Cu, and a, b and c are, in atomic percentages, $25 \leqq a \leqq 85$, $5 \leqq b \leqq 70$ and $0 < c \leqq 35$), and comprises at least 50% by volume thereof being an amorphous phase. The golf club head has a high strength and yet has a low elastic modulus.

5 Claims, 4 Drawing Sheets

GOLF CLUB HEAD

BACKGROUND OF THE INVENTION

1. Field of the Invention

This invention relates to a golf club head constituted by using an amorphous alloy having a glass transition range.

2. Description of the Prior Art

Recently, golf clubs which have a metal or alloy head and are called a "metal-wood" clubs, such as drivers, have been put on the market. These golf clubs have extended the flying distance of a hit ball and have made it easier-to hit the ball with higher directionality. Furthermore, various kinds of metal-wood golf clubs having a light titanium or titanium alloy head, which is particularly excellent in resilience and corrosion resistance among the metals or alloys, have been proposed. For example, Japanese Patent Laid-Open No. 367678/1992 discloses a golf club head made of titanium and a titanium alloy. A golf club head using duralmin has been proposed, too.

In other words, the material of the golf club head must be strong and light in weight, and has changed from a stainless steel to titanium and a titanium alloy and further to duralmin. To further extend the flying distance, the head must be stronger and lighter in weight and from this aspect, one of the applicants' assignees of the present application has proposed a material described in Japanese Patent Laid-Open No. 135931/1997.

SUMMARY OF THE INVENTION

In view of the transition of the technologies described above, the present invention aims at providing a golf club head which has a higher strength and a lower elastic modulus irrespective of its high strength.

The present invention is as follows:

(1) A golf club head comprising a face portion and a main body portion, wherein at least the face portion comprises an amorphous alloy having a glass transition range.

(1)-1 A golf club head comprising a face portion and a main body portion, wherein at least the face portion is made of an amorphous alloy having a glass transition range.

(1)-2 A golf club head comprising a face portion and a main body portion, wherein the face portion comprises a face main body and a face, and eat least the face is made of an amorphous alloy having a glass transition range.

(2) A golf club head according to the item (1), wherein the amorphous alloy has a glass transition range having a temperature width of at least 30 K.

(3) A golf club head according to the item (1) or (2), wherein the amorphous alloy has a composition represented by the general formula $X_aM_bAl_c$ (where X is at least one element selected from the group consisting of Zr and Hf, M is at least one element selected from the group consisting of Mn, Fe, Co, Ni, Ti and Cu, and a, b and c are, in atomic percentages, $25 \leqq a \leqq 85$, $5 \leqq b \leqq 70$ and $0 < c \leqq 35$), and comprises an amorphous phase in a volume fraction of at least 50%.

(4) A golf club head according to any of the items (1) through (3), wherein the amorphous alloy is a material obtained by compacting and consolidating powder consisting of an amorphous material.

(5) A golf club head according to the item (4), wherein the mean particle size of powder made of an amorphous material is not greater than 150 $\mu$m.

(6) A golf club head according to any of the items (1) through (3), wherein the amorphous alloy has a strength of at least 120 kgf/mm$^2$, an elastic modulus of at least 8,000 kgf/mm$^2$ to less than 11,000 kgf/mm$^2$ and a specific elastic modulus of at least 1,200 kgf/mm$^2$/g/cm$^3$ to 1,600 kgf/mm$^2$/g/cm$^3$.

(7) A golf club head according to any of the items (1) through (6), which comprises a solid main body portion and a face portion integrally bonded to the main body portion.

(8) A golf club head according to any of the items (1) through (6), which is hollow, and comprises a main body portion represented by a sole portion and a crown portion, and a face portion integrally bonded to the main body portion.

(9) A golf club head according to the item (8), wherein the face portion comprises a face main body and a face integrally bonded to the face main body.

(10) A golf club head according to the item (1) or (9), wherein the face portion is an amorphous alloy having a glass transition range, and the main body portion is an alloy different in structure and/or composition from the amorphous alloy.

(11) A golf club head according to the item (9), wherein both of the face portion and the main body portion are made of an amorphous alloy having a glass transition range.

DETAILED DESCRIPTION OF THE PREFERRED EMBODIMENT

Incidentally, though the item (3) described above represents the alloy having a specific composition, an alloy providing a similar effect can be obtained even when up to 5 at % of an element or elements such as C, B, Ge, Bi, etc, are contained in the alloy.

The inventors and their assignees of the present application have been engaged in the past in the development of a series of rapidly solidified alloys. They succeeded in forming an amorphous phase by rapidly solidifying the alloy materials having the specific compositions described above and proposed those materials which have a glass transition range useful for shape-processing such as casting and forging.

Generally, when amorphous alloys are heated to a glass transition range and are retained for a long time, crystallization starts occurring. However, the amorphous phase is stable in the alloys having a broad glass transition range as in the alloy used in the present invention, and if a suitable temperature within this range is selected as the processing temperature, there is no need to pay any specific attention to crystallization in ordinary shape-processing.

The term "glass transition range" means a temperature range between a crystallization temperature (Tx) of an amorphous alloy and a glass transition temperature (Tg). The glass transition temperature (Tg) represents the temperature at the point, at which the rise portion of a curve and an extrapolation of a base line cross each other at a portion where an endothermic reaction-occurs on a resulting differential scanning calorimetric curve when the amorphous alloy is subjected to a differential scanning calorimetry. The crystallization temperature (Tx) represents the temperature obtained similarly at the portion at which an exothermic reaction occurs, on the contrary.

In the amorphous alloy used in the present invention, the glass transition range (supercooling liquid range) $\Delta Tx=Tx-Tg$ is at least 30 K, and particularly in the Zr—TM—Al system amorphous alloy, the glass transition range is extremely broad such as at least 60 K. Because the glass transition range exists and because this range is broad, the alloy easily and unlimitedly undergoes plastic deformation at a low pressure, and temperature control during processing and control of a processing time can be mitigated. Further, a thin ribbon and powder can be easily consolidated and shaped by conventional processing methods such as extrusion, rolling, forging and hot press. Moreover, the processed (deformed) surface has extremely high smoothness due to the characteristics as glass (amorphous alloy), and a step which invites a slip belt on the surface such as when a crystalline alloy is deformed does not substantially occur.

Figure 1:
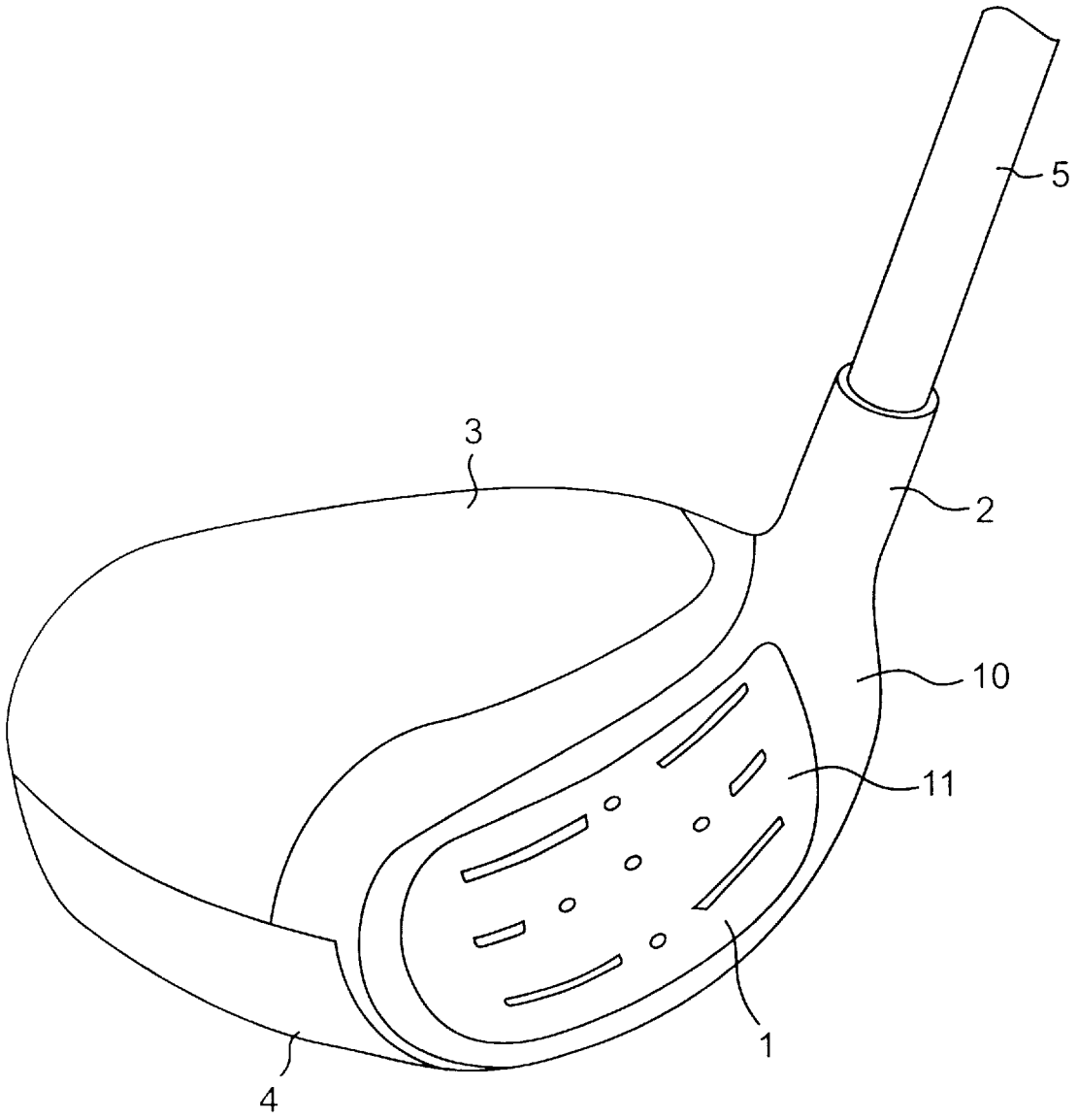
FIG. 1 is a perspective view showing an example of a hollow golf club head to which the present invention is applied.
Figure 2:
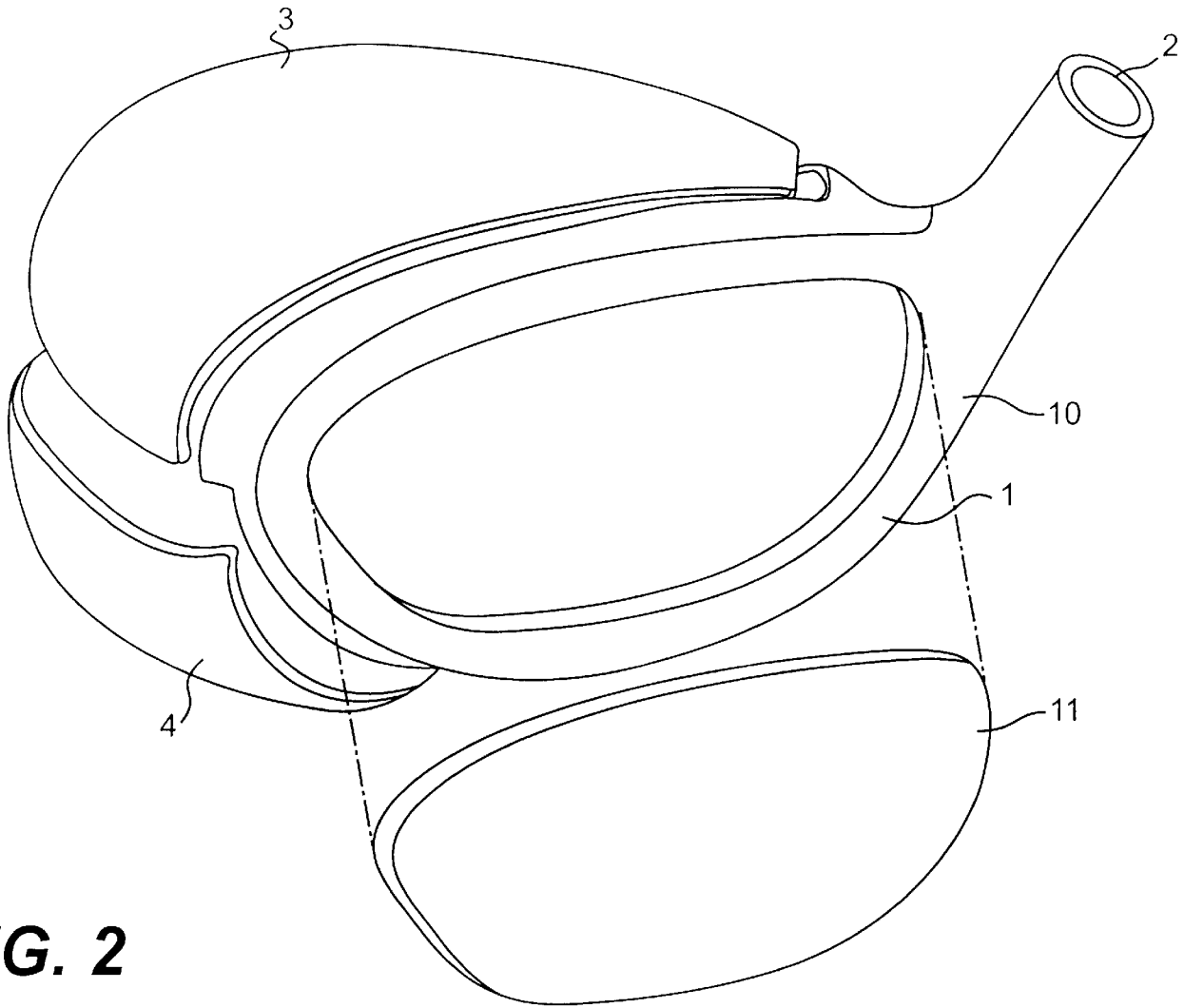
FIG. 2 is a perspective view of a hollow golf club showing each constituent member under the exploded state.
Figure 3:
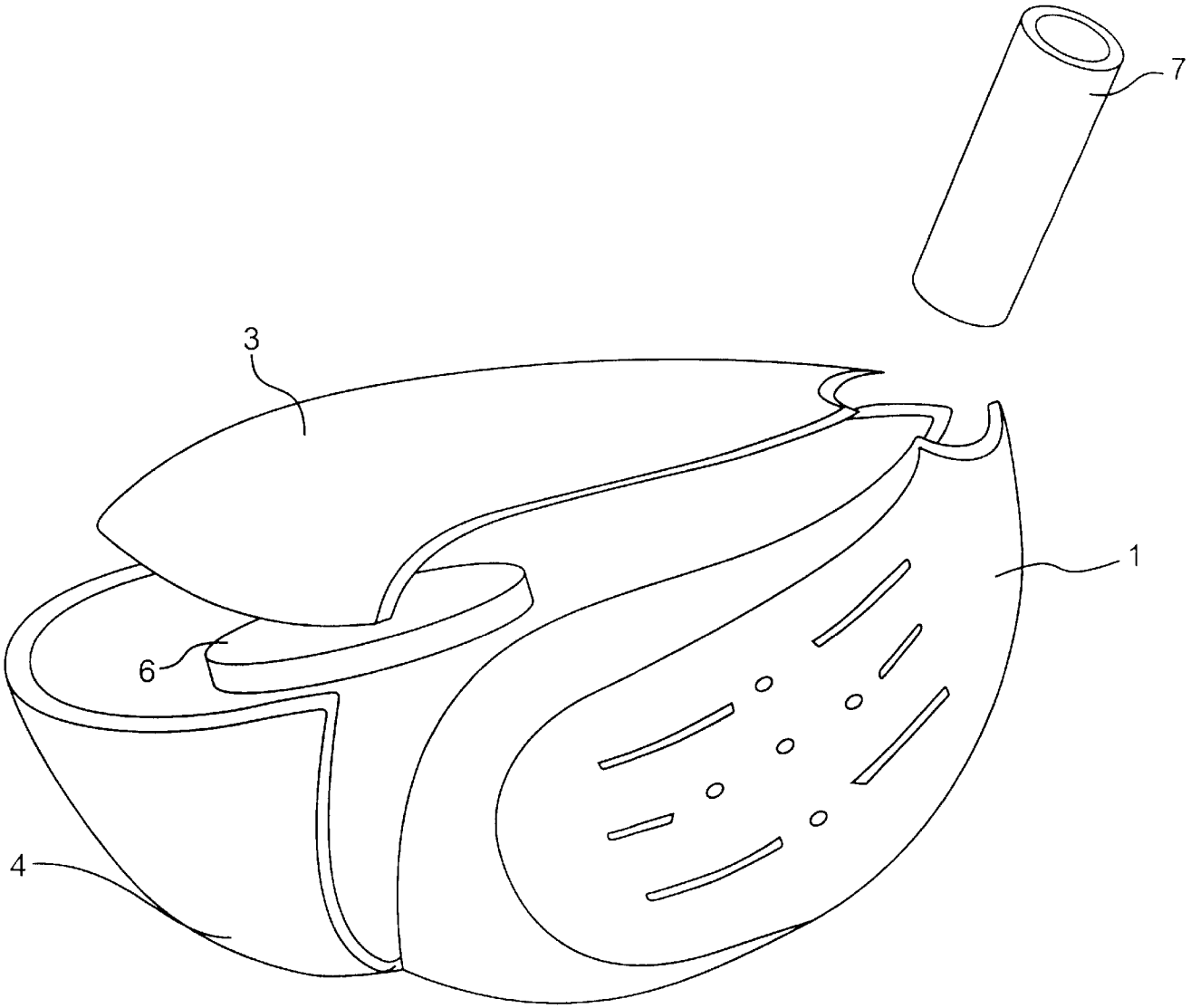
FIG. 3 is an exploded perspective view of a hollow golf club head according to another example.
Figure 4A:
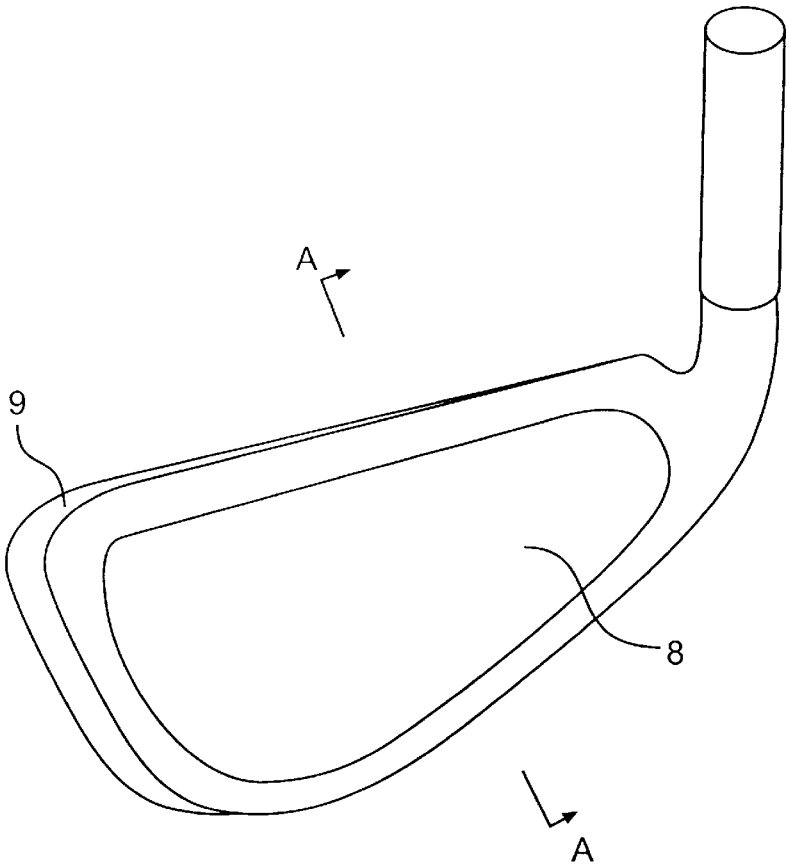
FIG. 4(A) is a perspective view of an iron type golf club head to which the present invention is applied and FIG. 4(B) is a sectional view taken along A—A of FIG. 4(A).
Figure 4B:
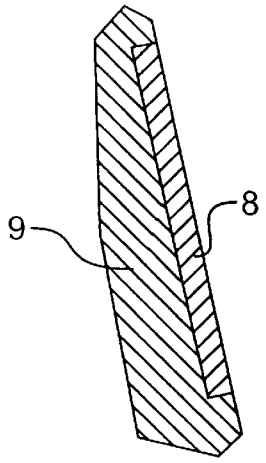

Typical examples of the golf club head as the object of the present invention include golf club heads made of a hollow metal as those shown in FIGS. 1 to 3 and a solid iron type golf club head as shown in FIGS. 4(A) and 4(B). However, the present invention is not particularly limited to these clubs but can of course be applied to those golf clubs in which the face portion is bonded to the main body portion made of a wood.

FIG. 1 shows a golf club head made of a hollow metal, which comprises the combination of a face portion 1 with a main body portion mainly consisting of a crown portion 3 and a sole portion 4. The face portion 1 comprises a face main body 10 and a face 11. Reference numeral 2 in the drawing denotes a hosel portion and reference numeral 5 denotes a shaft. The head is formed by integrally bonding these constituent portions by means such as bonding, welding, caulking and bolt fastening. FIG. 2 shows the constituent members before they are combined.

FIG. 3 is an exploded view of another example. The face main body 10 and the face 11 are integrally shaped, the hosel portion 7 is a separate component, and a balance weight 6 is put into the hollow portion.

FIGS. 4(A) and 4(B) show an example of an iron type club. In this example, the face 8 is buried into a solid main body portion 9. Incidentally, it is possible in the case of the hollow head to integrally cast the crown portion 3, the sole portion 4 and the face main body 10 and to integrally bond the face 11 to the resulting integral casting.

In the golf club heads of the types described above, the present invention constitutes at least the face portion or the face itself by the amorphous alloy having the glass transition range, and other members such as the main body portion or the sole portion, the crown portion and the hosel portion may be made of other metal. In the case of making only the face of the amorphous alloy, further the face main body may be made of other metal. Alternatively, the constituent members other than the face portion or the face may also be partly or wholly made of the same amorphous alloy as above.

As described above, the present invention uses the foregoing amorphous metal having the glass transition range as the material of at least the face portion or the face itself of the club head so as to use the feature of the material in which its elastic modulus is low irrespective of its high strength and high hardness. Because the material has high strength, the thickness and eventually, the weight, can be reduced and the size of the head can be increased. When the head is large, the target does not become small even when an elongated shaft is employed, and the problem of varying feeling resulting from the distance between the ball and the grip can be eliminated, so that the moment of inertia for increasing the flying distance of the ball by elongating the shaft can be improved. Because the weight of the golf club head can be reduced, the weight distribution around the head can be optimized and a sweet area can be expanded. In consequence, directionality of the hit ball and its flying distance can be stabilized. The low elastic modulus irrespective of high strength means high resilience and high impact efficiency. Accordingly, the flying distance of the hit ball can be improved.

Hereinafter, the present invention will be explained more specifically on the basis of Examples thereof.

EXAMPLES

Amorphous alloy powders each having a composition represented by $Zr_{60}Al_{15}Co_{2.5}Ni_{7.5}Cu_{15}$ or $Zr_{65}Al_{10}Ni_{10}Cu_{15}$ (where the subscript represents the atomic percentage of each element) were prepared by using a gas atomizer. The grains were adjusted so that each of the resulting powders had a mean particle size of 30 $\mu$m. After each powder was charged into a metallic capsule made of aluminum, degassing was carried out to prepare an extrusion billet. This extrusion billet was extruded by a billet extruder, and the metallic capsule portion covering the surface was then removed to obtain a billet. The extrusion temperature was within the glass transition range of the alloys described above. The glass transition range ($\Delta T$), the crystallization temperature (Tx) and the glass transition temperature (Tg) of each alloy were tabulated in Table 1.

TABLE 1

| alloy composition (at %) | $\Delta T$ (K) | Tx (K) | Tg (K) |
|---|---|---|---|
| $Zr_{60}Al_{15}Co_{2.5}Ni_{7.5}Cu_{15}$ | 116 | 768 | 652 |
| $Zr_{65}Al_{10}Ni_{10}Cu_{15}$ | 106 | 736 | 630 |

The resulting billet was placed into a mold having the shape of the face 11 shown in FIG. 2, was heated to the glass transition range and was forged into the shape shown in FIG. 2. The face main body, the sole portion and the crown portion each made of a Ti alloy were produced by forging and after they were welded, the face was caulked and fixed to the face main body and was finally fitted to the shaft 5 (FIG. 1). As a result, the golf clubs shown in FIG. 1 was obtained. The head had a volume of 270 cc and a weight of 195 g.

The strength, the specific strength, the elastic modulus, the specific elastic modulus, the specific gravity and the hardness of the amorphous alloys used in this example, the Ti base alloy as well as the 7075 alloy of the Al base alloy used conventionally as the golf club head material, and the rapidly solidified Al base alloy described in Japanese Patent Laid-Open No. 135931/1997, were shown in Table 2.

TABLE 2

| | Material | Strength ($kgf/mm^2$) | Specific strength ($kgf/mm^2/g/cm^3$) | Elastic modulus ($kgf/mm^2$) | Specific elastic modulus ($kgf/mm^2/g/cm^3$) | Specific gravity | Hardness (Hv) |
|---|---|---|---|---|---|---|---|
| Example 1 | $Zr_{60}Al_{15}Co_{25}$. $Ni_{7.5}Cu_{15}$ | 159 | 23.7 | 9100 | 1360 | 6.7 | 460 |
| Example 2 | $Zr_{65}Al_{10}Ni_{10}$. $Cu_{15}$ | 148 | 22.7 | 9200 | 1410 | 6.5 | 430 |
| Comparative Example 1 | Ti base alloy | 110 | 24.4 | 11000 | 2440 | 4.5 | 315 |
| Comparative Example 2 | 7075 alloy | 58 | 20.7 | 7200 | 2570 | 2.8 | 155 |
| Comparative Example 3 | $Al_{93}Ni_6Mm_{0.9}$. $Ag_{0.1}$ | 78 | 26.8 | 9500 | 3280 | 2.9 | 220 |

As can be seen clearly from Table 2, the amorphous alloy used in the present invention are superior in the strength and the hardness to the comparative materials but its specific elastic modulus is lower. Therefore, the golf club head of the present invention is superior.

The analysis and the structural observation reveal that predetermined portions of the golf club head so produced comprise an amorphous single-phase. Further, each constituent unit of the face portion 1, the sole portion 4 and the crown portion 3 was individually produced in the same way as the face as shown in FIG. 3, and these members were then bonded by welding to produce a golf club head. The resulting golf club head provided the similar result to the result described above, and a similar effect could be expected.

The example given above represents the alloy consisting mainly of Zr, and the similar characteristics can be obtained in the same way as in the example by using the alloy consisting mainly of Hf and the alloy in which the M component is appropriately changed within the range of the present invention.

The present invention conjointly uses the high strength material for at least the face portion as the material of the golf club head and can therefore provide a golf club head which has high resilience and high impact efficiency and can drive the ball to a long distance without lowering the initial speed. Because the thickness can be reduced, the size of the head can be increased, and the problem of the varying feeling due to the distance can be eliminated even when the shaft is elongated. Therefore, the elongated shaft can be employed and the centrifugal force of the club head at the time of hitting of the ball can be improved. Consequently, the ball-hitting speed and the flying distance can be increased. Further, because the amorphous alloy having the glass transition range is used, the excellent characteristics inherent to the material can be maintained without being lost during molding.

What is claimed is:

1. A golf club head comprising a face portion and a main body portion, wherein said golf club head is hollow, and said main body portion comprises a sole portion, a crown portion and a face portion, which portions are integrally bonded, wherein at least said face portion comprises an amorphous alloy having a glass transition temperature range of at least 30 K, a strength of at least 120 $kgf/mm^2$ and an elastic modulus of about 8,000 $kgf/mm^2$ to about 11,000 $kgf/mm^2$, said amorphous alloy has a composition represented by a general formula $X_aM_bAl_c$, were X is at least one element selected from the group consisting of Zr and Hf, M is at least one element selected from the group consisting of Mn, Fe, Co, Ni, Ti and Cu, and a, b and c are, in atomic percentages, $25<a<85$, $5<b<70$ and $0<c<35$, and comprises an amorphous phase in a volume fraction of at least 50%, wherein said amorphous alloy is obtained by compacting and consolidating powder made of an amorphous material, wherein the mean particle size of said powder is not greater than 150 $\mu$m.

2. A golf club head according to claim 1, wherein said face portion comprises a face main body and a face integrally bonded to said face portion main body.

3. A golf club head according to claim 1, wherein said face portion or said face is an amorphous alloy having a glass transition range, and said main body portion is an alloy different in either or both structure and composition from said amorphous alloy.

4. A golf club head according to claim 2, wherein said face portion or said face is an amorphous alloy having a glass transition range, and said main body portion is an alloy different in structure and/or composition from said amorphous alloy.

5. A golf club head according to claim 2, wherein both of said face portion and said main body portion are made of an amorphous alloy having a glass transition range.

* * * * *

UNITED STATES PATENT AND TRADEMARK OFFICE

CERTIFICATE OF CORRECTION

PATENT NO. : 6,162,130
DATED : December 19, 2000
INVENTOR(S) : Tsuyoshi Masumoto et al.

It is certified that error appears in the above-identified patent and that said Letters Patent is hereby corrected as shown below:

Title page,
Item [73], in the Assignees, "Noue" should read -- Inoue --.

Column 6,
Line 28, "were X" should read -- where X --.
Line 32, "25<a<85, 5<b<70" should read -- $25 \leq a \leq 85$, $5 \leq b \leq 70$ --.
Line 33, "$0 < c < 35$" should read -- $0 \leq c \leq 35$ --.
Line 49, "in structure and/or composition" should read -- in either or both structure and composition --.

Signed and Sealed this

Thirtieth Day of April, 2002

*Attest:*

*Attesting Officer*

JAMES E. ROGAN
*Director of the United States Patent and Trademark Office*